United States Patent [19]

Harcúba et al.

[11] 3,991,602

[45] Nov. 16, 1976

[54] PRESS FOR COLD FORMING OF WORKPIECES FROM A METAL SHEET

[75] Inventors: Siegfried Harcúba, Saarbrucken; Herbert Dits, Schmelz, both of Germany

[73] Assignee: Siegfreid Harcúba, Saarbrucken, Germany

[22] Filed: July 8, 1975

[21] Appl. No.: 594,014

[30] Foreign Application Priority Data

July 9, 1974 Switzerland ..... 9438/74

[52] U.S. Cl. ..... 72/455; 72/453.01; 72/456; 100/231

[51] Int. Cl.[2] ..... B21J 13/04

[58] Field of Search ..... 72/455, 456, 453; 100/231

[56] References Cited

UNITED STATES PATENTS

| | | | |
|---|---|---|---|
| 2,051,447 | 8/1936 | Johnson | 100/231 |
| 2,461,034 | 2/1949 | Castle | 72/453 |
| 2,916,987 | 12/1959 | Hanni | 100/231 |

FOREIGN PATENTS OR APPLICATIONS

| | | | |
|---|---|---|---|
| 613,455 | 1/1961 | Canada | 72/456 |

*Primary Examiner*—C.W. Lanham
*Assistant Examiner*—Gene P. Crosby
*Attorney, Agent, or Firm*—Oblon, Fisher, Spivak, McClelland & Maier

[57] ABSTRACT

A press for cold forming of workpieces from a metal sheet, wherein one of the upper tool and the lower tool is connected with a piston actuated by pressure means, having at least one C-frame, characterized by a guide frame carrying a cylindrical body with the upper tool, the guide frame being bodily separated from the C-frame, and by a compensating body loosely positioned between the cylindrical body and the upper arm of the C-frame, or a crossbar connecting the upper arms of the C-frames, the compensating body being coaxial with the upper and lower tools and swingable in the plane running perpendicularly to the plane of the guide frame.

4 Claims, 4 Drawing Figures

PRESS FOR COLD FORMING OF WORKPIECES FROM A METAL SHEET

BACKGROUND OF THE INVENTION

The invention relates to a press for cold forming of workpieces from a metal sheet having a base frame, at least one C-frame, an upper and a lower tool, whereby one of the upper tool and the lower tool is connected with a piston actuated by pressure means or by an eccenter disc.

In different working processes, especially in sheet metal machining, presses of different forms are used, the frames of which are carried out according to the magnitude of the forces occurring during the working process. The versatility of the presses is enhanced when the height of the interior working space is bigger and when the stroke is accordingly higher because, in such a case, high tools and high drawing devices can be mounted in the press. The presses for cold forming of workpieces having C-frames have an advantage of being accessible on three sides as against the frames having two columns which are accessible on two sides only.

A disadvantage of the presses having C-frames consists in that they are elastic because of the forces occurring during the working process. The elastic movement of the C-frame takes place both in the vertical axis and in the horizontal axis of the press. The most important elastic movement is, however, that one caused by the swinging motion of the upper arm of the C-frame in a vertical axis lying perpendicularly to the plane passing through the upper and the lower arms of the C-frame. Owing to this swinging motion, the upper tool attached to the upper arm of the C-frame is displaced in respect to the lower tool, resulting in faulty products, which is comprehensible. The number of the elastic movements is 100 kg/$\mu$ in average with presses of 60 – 100 t of nominal capacity. Small presses have a smaller number and big presses have a higher number of elastic movements. Owing to this elastic movement, the tools are worn off quicker and the stability of their cutting edges gets worse. The working life of such a tool is accordingly shorter.

In order to withstand the forces occurring during the working process, the C-frames have to be built rigidly, by such a rigid construction the elastic movements of the C-frame should be eliminated as far as possible.

SUMMARY OF THE INVENTION

It is an object of the invention to do away with the above-mentioned shortcomings and to propose a press for cold forming workpieces of the above-mentioned art in which the angle divergence of the upper tool from the vertical axis passing through the upper as well as the lower tool should be avoided, and to permit a light construction of the press.

A press for cold forming of workpieces from a metal sheet is characterized by a guide frame which is bodily separated from a C-frame and carries a cylindrical body, the guide frame being attached to the base frame independently of the C-frame, and by a compensating body which is loosely positioned between the cylindrical body and the upper arm of the C-frame, or a crossbar connecting the upper arms of the C-frames, the compensating body being coaxial with the upper and lower tools and swingable in the plane running perpendicularly to the plane of the guide frame by an angle from the vertical axis passing through the upper and lower tools.

It is advantageous that the compensating body is supported on the one hand in a first ladle fixed to the cylindrical body and on the other hand in a second ladle, fixed to the upper arm of the C-frame, or to a crossbar connecting both the C-frames.

BRIEF DESCRIPTION OF THE DRAWINGS

Other objects and features of the invention will be set forth more fully hereinafter. The full nature of the invention will be understood from the accompanying drawings in which.

DETAILED DESCRIPTION OF THE PREFERRED EMBODIMENTS

Figure 1:
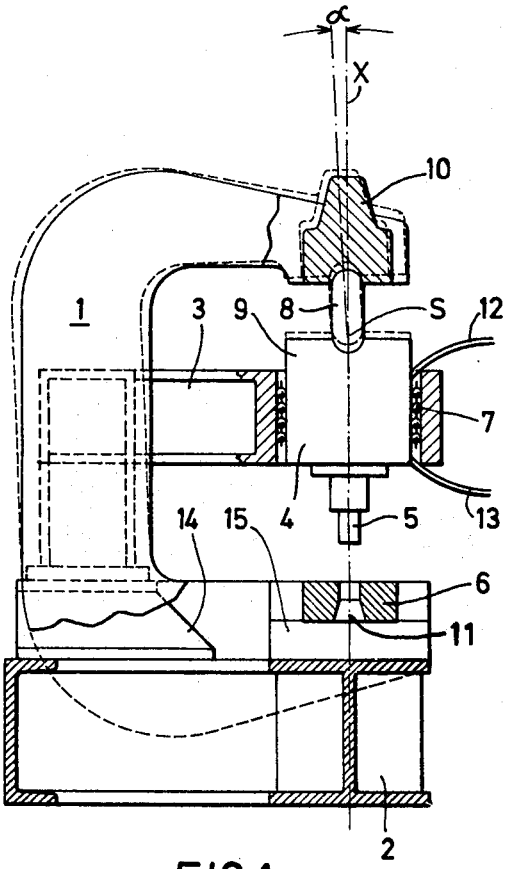
FIG. 1 is a schematic side view of a press with two C-frames and a guide frame, partially in section.
Figure 2:
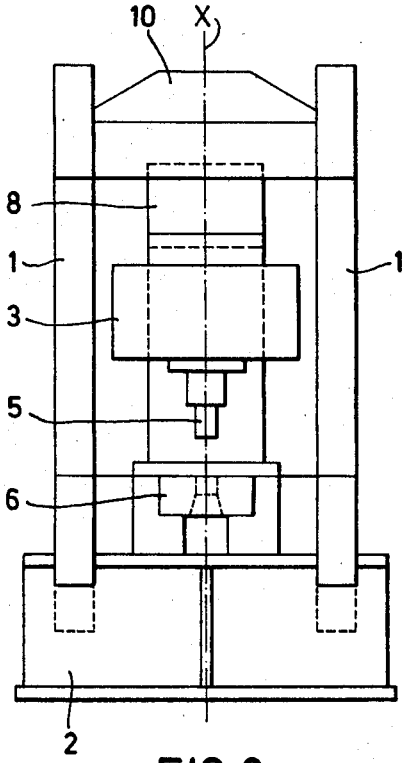
FIG. 2 is an elevation of the press shown in FIG. 1.

The press for cold forming of workpieces from a metal sheet shown in FIGS. 1 and 2 comprises a base frame 2 in which two parallel C-frames 1 are anchored, being distanced from each other. Both the C-frames 1 are connected to each other both by the base frame 2 and by a crossbar 10. Between both the frames 1 there is placed a guide frame 3. It is bodily separated from both the C-frames 1 and attached with its bottom plate 14 to the base frame 2. Its arm supporting a cylindrical body 4 extends between the upper and the lower arms of both the C-frames 1. A piston, not shown, with a piston rod, is positioned in the cylindrical body 4, which is axially guided by means of ball bearings 7 in the guide frame 3. The piston rod is connected with an upper tool 5. The piston is actuated e.g., by pressure water or pressurized air, which pressure means are supplied and discharged to or from the same by hoses 12 and 13.

Instead of the upper tool, the lower tool can be connected with a piston actuated by the pressure means. Instead of the work cylinder e.g., an eccentric drive can be provided.

A lower tool 6 lies on a base plate 15 affixed to the base frame 2. The upper tool 5 is axially aligned with the lower tool 6, lying between both the arms of the C-frames. A compensating body 8, which is axially aligned with the upper tool 5 and the lower tool 6, is positioned on the vertical axis $x$ passing through the upper and the lower tools 5 and 6 between the cylindrical body 4 and the crossbar 10. This compensating body 8 is loosely positioned on one hand in a ladle 9 attached to the cylindrical body 4 and on the other hand in a crossbar 10. In an embodiment having only one C-frame there is attached a second ladle to the upper arm of the same, in which ladle the other end of the compensating body 8 is loosely positioned. Owing to this positioning it is possible that the compensating body 8 can be swung by an angle $\alpha$ from the vertical axis $x$ in a vertical plane passing through the guide frame 3. Simultaneously with the compensating body, the crossbar 10 and the arms of the C-frames 1 connected together by the same, or only the upper arm of one C-frame, are swung out.

The elastic movement about a horizontal axis, caused by the forces occurring during the working process, will be absorbed by the compensating body 8 so that the cylindrical body 4 with the upper tool 5 rests always in the vertical axis $x$. The appex S of the angle $\alpha$ remains during the elastic movement of the compensating body 8 always in the vertical axis $x$. By the separate arrangement of the guide frame 3 from the C-frame(s) 1, faultless products will be produced from a metal sheet strip, not shown, whereby the ready-made workpiece or the waste will be removed through an opening 11 in the lower tool 6.

Owing to the separate arrangement of the guide frame 3, the elastic movement acting in the horizontal direction is eliminated, whereby the elastic movement acting in the vertical axis $x$ does not play any role.

The main advantage of the above-described press consists in that the weight of the press having C-frames is much lower than that one of normal presses, which weight reduction is achieved by the above-described arrangement.

When sequence tools acting one after another are applied, the force of the press does not consist of a sum of forces of, e.g., four singular tools, as it is the case with combination tools. Accordingly, the purpose can be achieved by one single, considerably lighter press.

The known presses with C-frames having a hydraulic or electromechanic drive are deficient in comparison with the above-described press not only for economic reasons but by means of an additional device, described further in detail, the nominal force of the press is considerably reduced, which brings further technical and economical advantages.

Because of the elastic movement of the frame, the known presses of the known constructions are not suitable for machining the plastic materials or non-ferrous metals, which are difficult to treat. The machining of the plastic materials or non-ferrous metals requires special presumptions which are fulfilled by the above-described press. Owing to the construction of the known presses, the use of a pneumatic-hydraulic drive is not possible.

The known presses with C-frames do not possess as well the high accuracy which can be achieved only by applying the loosely positioned compensating body.

As an example of sequence tools, such tools are taken into consideration which serve for producing a complicated die of a workpiece in punching, stamping, bending and cutting operations. For this purpose, a press having a C-frame is indispensible.

Figure 3:
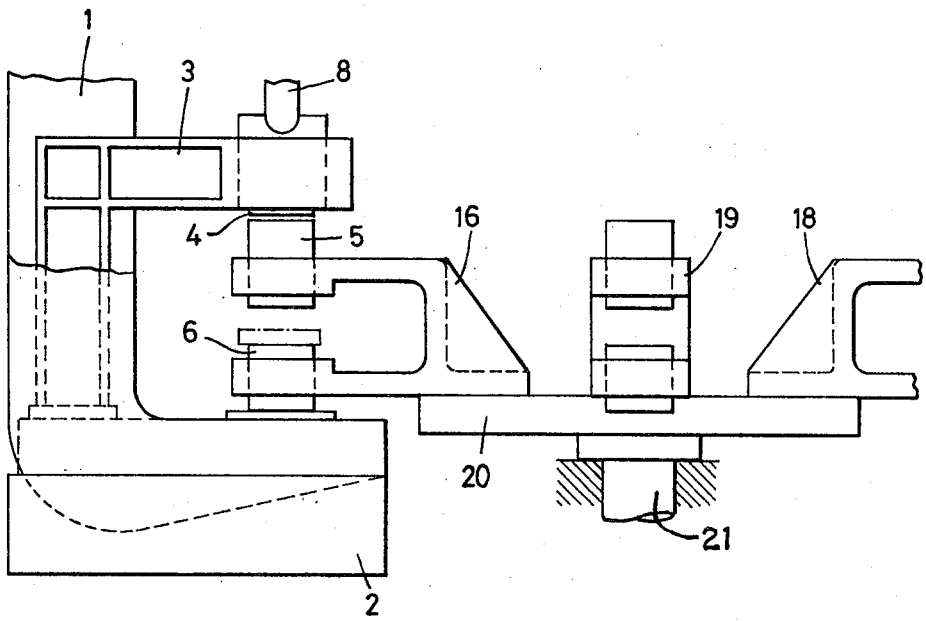
FIG. 3 is a sectional side view of the press shown in FIG. 1, comprising a device having four sequence tools arranged outside the press, and FIG. 4 a plan view of the arrangement according to FIG. 3.
Figure 4:
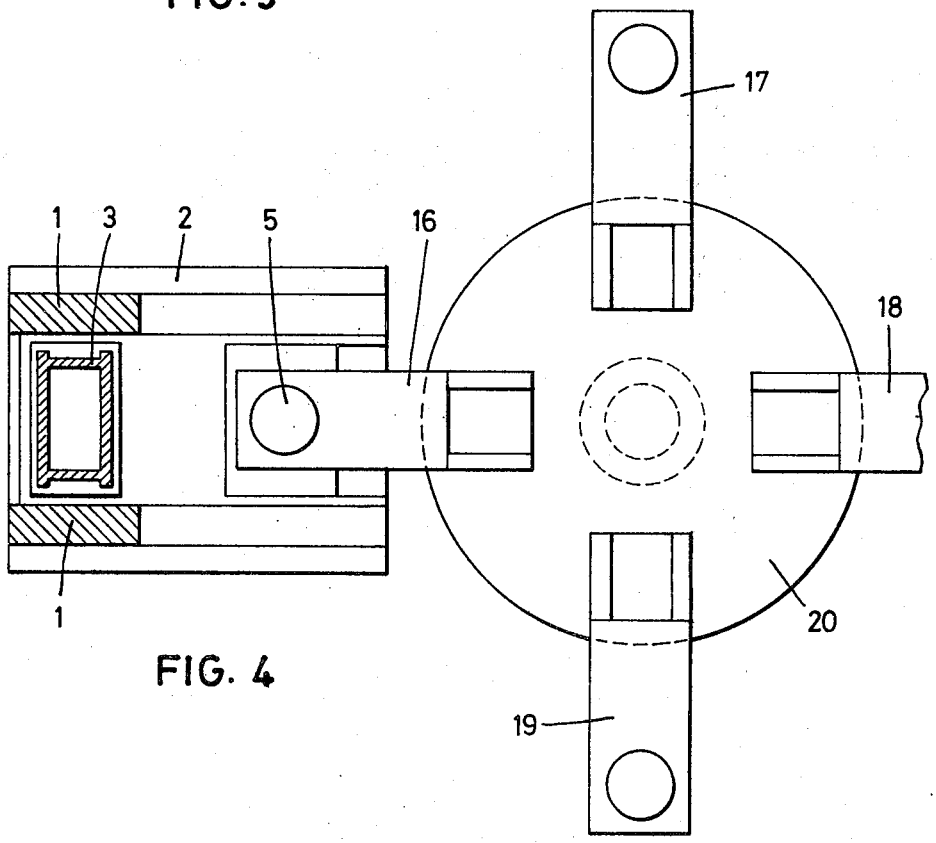

These four individual tools, which are positioned on a rotating disc 20 are mounted according to FIGS. 3 and 4 in slotted jaws 16, 17, 18 and 19. The disc 20 is arranged outside the frame 1 of the press and is movable around its vertical axle 21 and can be stopped in the required position. The slotted jaws 16, 17, 18 and 19 are brought one after another in the axis of the press by the rotation of the disc 20. For this purpose, a free access space is required which is occupied with the presses having no C-frame by frame parts and anchoring rods.

Combination tools which unite the above-mentioned four working processes can be used on four usual hydraulic presses; however, a much higher press force is to be taken in account than with the above-described press because the sum of four individual forces has to be simultaneously applied. In another case in which four individual tools are used one after other, a special press is required for each tool.

What is claimed is:

1. A press for cold forming of workpieces from a metal sheet having a base frame, at least one C-frame, an upper and a lower tool, one of said upper tool and said lower tool being connected with a piston actuated by pressure means, characterized by a guide frame which is bodily separated from said C-frame and carries a cylindrical body, said guide frame being attached to said base frame independently of said C-frame, and by a compensating body which is loosely positioned between said cylindrical body and a crossbar connecting said upper arms of said C-frames, said compensating body being coaxial with said upper and lower tools and swingable in the plane running perpendicularly to the plane of said guide frame by an angle $\alpha$ from the vertical axis passing through said upper and lower tools.

2. A press according to claim 1, characterized in that said compensating body is supported on the one hand in a first ladle fixed to said cylindrical body and on the other hand in a second ladle fixed to said crossbar connecting both the C-frames.

3. A press according to claim 1, characterized in that, during the swinging motion of the compensating body, the apex of the angle rests always on the vertical axis passing through said upper and lower tools.

4. A press according to claim 1, characterized in that said cylindrical body with the upper tool is axially guided in the guide frame.

* * * * *